United States Patent [19]

Rowe

[11] 3,945,211

[45] Mar. 23, 1976

[54] VACUUM ENGINE

[76] Inventor: Bernard D. Rowe, 4312 Babcock Ave., Los Angeles, Calif. 91604

[22] Filed: May 2, 1974

[21] Appl. No.: 466,189

[52] U.S. Cl. ..... 60/649; 60/508; 60/673

[51] Int. Cl.[2] ..... F01K 25/06

[58] Field of Search ..... 60/673, 649, 651, 671, 60/508, 509, 511, 512, 514, 531

[56] References Cited

FOREIGN PATENTS OR APPLICATIONS

| | | | |
|---|---|---|---|
| 29,690 | 12/1897 | United Kingdom | 60/673 |
| 294,882 | 9/1929 | United Kingdom | 60/673 |

*Primary Examiner*—Allen M. Ostrager
*Attorney, Agent, or Firm*—Lyon & Lyon

[57] ABSTRACT

A system for generating power in a variable volume engine using a liquid solvent and a soluble gas. Power is generated by decreasing the pressure within one or more variable volume chambers through the solution of ammonia in water when each chamber is at or near a maximum volume. The resulting differential between the atmospheric pressure and the reduced pressure within the chamber is used to generate mechanical power. The combing of the water and ammonia gas may take place within a conventional cylinder at a point in time when the associated piston is approximately bottom dead center. In a second embodiment, the ammonia and water is mixed in a tank at a remote location from the piston and cylinder. The cylinder is operatively connected with the tank such that the vacuum developed in the tank may be employed within the cylinder for the production of power.

10 Claims, 3 Drawing Figures

FIG. 1
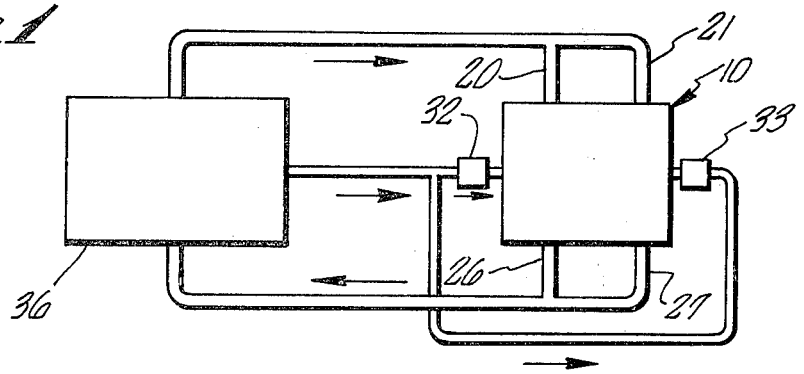
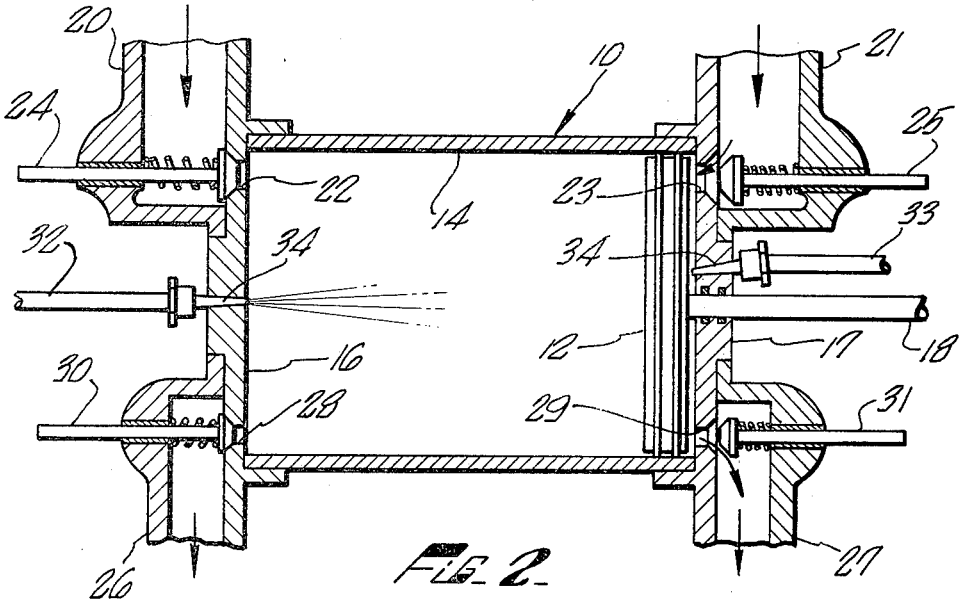
FIG. 2
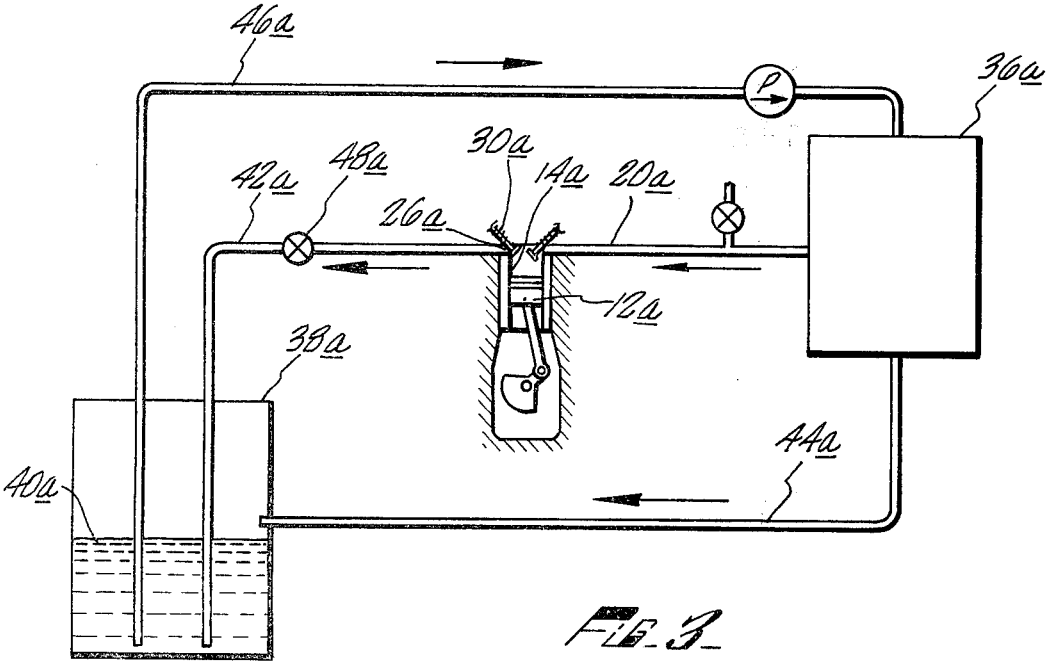
FIG. 3

VACUUM ENGINE

The present invention is directed to a variable volume engine employing the vacuum created through the solution of a gas in a liquid to derive power.

Water-ammonia engines have been developed which employ the pressure derived from heating ammonia water solutions. When the solution is heated, ammonia gas is driven off. This pressurized ammonia is employed to drive a variable volume engine. The ammonia is then redissolved in water and the process is repeated.

The present invention employs a system whereby power is derived from the vacuum created through the solution of ammonia in water. A range of configurations may be employed to operably derive power from the solution of ammonia in water. A plurality of conventional cylinders and pistons employing a water injection system may be used. Alternately, a remote solution tank may be used to develop a vacuum. The vacuum may then be employed to run any one of a number of variable volume engines.

Accordingly, it is an object of the present invention to provide a variable volume engine employing the solution of a gas in a liquid solvent to provide power.

It is another object of the present invention to provide a variable volume engine employing the vacuum created by the solution of ammonia in water to derive power.

It is a further object of the present invention to provide a method for producing power using the vacuum generated by the solution of a gas in a solvent.

FIG. 1 illustrates a schematic flow system for the present invention.

FIG. 2 illustrates a variable volume chamber employing the present invention.

FIG. 3 schematically illustrates a second embodiment of the present invention employing a remote water-ammonia solution chamber.

Turning first to the embodiment illustrated in FIGS. 1 and 2, a variable volume chamber arrangement generally designated 10 is illustrated. The chamber arrangement 10 illustrated in FIG. 2 and schematically shown in FIG. 1 includes a double acting piston 12 located within a cylinder 14. Naturally, a single acting piston may be employed and any number of chamber arrangements may be associated in any given engine. The present invention may also be practiced with a variable volume rotary engine as well. The principles of the present invention are simply duplicated by multiple cylinders; consequently, only a single cylinder 14, will be discussed. Further, because of the effects of the pressure differential across the piston 12, the more complex yet advantageous use of the double acting piston will be specifically set forth.

In FIG. 2, a first chamber is defined by the cylinder 14, a first head 16 and the piston 12. A second chamber is formed from the piston, the cylinder 14 and a second head 17. The volumes thus defined vary inversely as the piston 12 moves in the cylinder 14. Power may be transferred through a piston rod 18 in a conventional manner. Intake manifolds 20 and 21 are positioned in association with the heads 16 and 17 respectively to provide intake passageways to the variable volumes within the cylinder 14. Valve ports 22 and 23 provide communication between the cylinder 14 and the intake manifolds 20 and 21. The intake passageways are controlled by means of valves 24 and 25 which may be conventionally driven by cams (not shown). The seats for the intake valves 24 and 25 are positioned outside the ports because a vacuum rather than a pressure is created within the cylinder 14. A conventional popet valve could be employed where it is found to be more convenient or practical. However, a substantial spring would be required to prevent leakage into the cylinder.

Exhaust passageways are also provided by exhaust manifolds 26 and 27. Similarly, exhaust ports 28 and 29 provide communication between the exhaust manifolds and the cylinder 14. Valves 30 and 31 cooperate with the exhaust ports 28 and 29 to provide controlled exhaust passageways from the cylinder 14. The exhaust ports 28 and 29 are preferably at the lower end of the cylinder 14. In this way, any liquid which may build-up in the cylinder will be assured of exhausting immediately therefrom.

Means are provided for mixing a liquid with the gas which is provided to the chambers. Injector systems 32 and 33 such as presently used to inject gasoline or diesel fuel into an internal combustion engine are here employed and the mixing occurs within the cylinder in the present embodiment. The injector systems 32 and 33 include injector nozzles 34 extending through the heads 16 and 17 to communicate with the interior volumes of the cylinder 14. It is believed advantageous to provide a high pressure injection of liquid in order that the liquid will be well distributed in the cylinder for interaction with the gas therein. Thus, an intake passageway and exhaust passageway and a liquid injector are provided for each variable volume chamber.

Each variable volume chamber experiences a sequence of events resulting in the production of useful power by the engine. The sequences in the present, double acting piston configuration must also be timed relative to one another as will be discussed below. A gas is provided to the intake manifolds 20 and 21. Further, a liquid is provided to the injector systems 32 and 33. The gas is of a type soluble in the liquid. In the present embodiment, it is contemplated that ammonia gas will be employed with water wherein the temperature of the resulting solution is maintained at a level such that the vapor pressure of the ammonia is as low as is practical. The resulting mixture creates a substantial reduction in pressure which may be advantageously employed to create mechanical power.

Looking first to the first chamber as seen in FIG. 2 on the left, when the piston 12 is near its closest approach to the cylinder head 16, the corresponding intake valve 24 is opened. Thus communication is provided between the intake manifold 20 and the small volume defined by the cylinder 14, the piston 12 and the adjacent cylinder head 16. The piston is then allowed to move away from the cylinder head 16 thereby drawing ammonia gas into the volume created. Once the piston 12 has reached the outer end of its stroke, the intake valve 24 is closed. Water is then dispersed into the cylinder 14 through the injector nozzle 34. This injection is preferably made under extreme pressure in order that substantial defusion of the incoming water in the ammonia gas will result. Instantaneously, the ammonia gas will start to dissolve in the water. This results in a reduction of pressure within the chamber 14. This reduction in pressure creates a differential across the piston with the pressure present on the other side of the piston 12. This differential causes the piston to be driven toward the cylinder head 16. The force of the pressure on the piston 12 is transferred to the piston rod 18 and is conventionally derived as rotational power by the engine. As the piston 12 closely approaches the cylinder head 16, the exhaust valve 30 is actuated, thereby creating communication between the exhaust manifold 26 and the interior portion of the cylinder 14. In this way, the water-ammonia mixture may be exhausted from the cylinder. At this time, a new charge of ammonia gas is allowed to flow into the cylinder 14.

Turning to the second chamber as seen in FIG. 2, the same sequence of events occurs. However, as the differential pressure across the piston is important, consideration must be given to the operation of the two chambers together. When the water is dispersed into the first chamber resulting in the reduction of pressure within the chamber, the inlet valve 25 is opened to provide communication between the intake manifold 21 and the second chamber. This chamber is at or near a minimum volume at this time. Consequently, ammonia gas under atmospheric (or higher) pressure can then enter this chamber through inlet valve 25. The pressure differential across the piston 12 causes the piston 12 to be driven toward cylinder head 16. The force of this gas pressure in the second chamber on piston 12 is transferred to piston rod 18 and is derived as power by the engine. Once the piston 12 has reached the end of its stroke, the intake port 23 is closed and water is dispersed into cylinder 14 through the other injector nozzle 35. This results in a reduction of pressure within the second chamber and the new charge of ammonia gas flowing in through intake valve 24 drives the piston 12 back toward cylinder head 17.

As seen in FIG. 1, the intake manifolds 20 and 21, the exhaust manifolds 26 and 27 and the injection systems 32 and 32 are coupled with a means of providing ammonia gas to the engine. This means, generally designated 36 is illustrated schematically. Several alternative systems may be employed as a means for providing ammonia gas and water to the engine. These means are conventionally provided and do not constitute an individual portion of the present invention. One configuration would include separate tanks. The first tank would contain pressurized ammonia gas, the second would contain water and the third would receive ammonia water exhausted from the engine. In such an instance, stations may be provided throughout a community to receive the exhausted ammonia gas tanks and the full ammonia water tanks and reconvert the ammonia water to ammonia gas and water which could be resold to the customer. Alternately, a small conversion plant may be established immediately adjacent the engine. In this case, the schematic block 36 in FIG. 1 would represent such a plant. Fuel could be used to heat the exhausted ammonia water to create new ammonia gas for use in the engine. The water may then be recycled to the injector system 32. In such a closed system, only combustable fuel will be required to sustain operation.

A second embodiment using the same principles of the present invention is schematicaly illustrated in FIG. 3. In the embodiment of FIG. 3, ammonia gas and water are not mixed within the conventional cylinder 14*a*. Rather, a separate solution tank 38*a* is provided at a remote location from the cylinder 14*a*. The solution tank 38*a* is charged with water 40*a*. A pipe leads from the exhaust manifold 26*a* into the solution tank 38*a* to a position within the water 40*a*. This pipe 42*a* thereby provides communication between the cylinder 14a in which is located the piston 12*a* and the solution tank 38*a*. Ammonia gas is supplied to the cylinder 14*a* through an intake manifold 20*a* from the means for providing gas 36*a*. The ammonia gas may be supplied at whatever pressure is available through the intake manifold 20*a*. As the incoming gas is supplied to the cylinder 14*a* when the piston 12*a* is moving downwardly, any pressure in the ammonia gas 20*a* will be converted to power in the engine. Once the piston has reached bottom dead center, the exhaust valve 30*a* is opened and the ammonia gas is allowed to flow through the pipe 42*a* to the solution tank 38*a*.

As the ammonia gas enters the solution tank 38*a*, it comes into association with the water 40*a* located therein. The ammonia then goes into solution creating a vacuum. The solution tank 38*a* is sealed in order that the vacuum may be maintained. Because of the vacuum, the ammonia within the cylinder 14*a* also experiences a decrease in pressure. The piston 12*a* is exposed to atmospheric pressure from beneath and consequently experiences a differential pressure between the two sides thereof. Because of the differential pressure, the piston 12*a* is forced upwardly in a power stroke.

A fresh water supply pipe 44*a* is provided to the solution tank 38*a* in order that the supply of unsaturated water may be replenished. Further, an exhaust pipe 46*a* draws ammonia water from the solution tank 38*a*. This ammonia water may be processed to separate the water and the ammonia for recycling. It is advantageous to provide an initial vacuum within the solution tank. This prevents any air which would otherwise remain from reducing the efficiency of the system. This vacuum will then remain for repeated uses of the engine. Naturally, it is important to keep the entire system sealed.

This second embodiment may also be employed in a double acting piston configuration such as shown in FIG. 2. Naturally, the injectors 32 and 33 would be removed. Exhaust manifolds 26 and 27 are connected to the solution tank 38*a* by pipe 42*a* (as shown in FIG. 3). When piston 12 reaches the end of its stroke toward cylinder head 17, the intake valve 24 is closed and outlet valve 30 is opened. Because of the vacuum in tank 38*a*, the gas leaves the first chamber 14 through outlet port 28 and pipe 42*a* creating a vacuum in said chamber. At this time, intake valve 25 is opened and ammonia gas enters the chamber on this side of piston 12 driving it toward cylinder head 16. At the moment the piston reaches the end of its stroke towards cylinder head 16, the outlet valve 30 closes and intake valve 24 opens; intake valve 25 closes and outlet valve 31 opens connecting the cylinder, which is now at maximum volume, to the solution tank 38*a* and the vacuum therein, resulting in a low pressure area within the cylinder. Gas entering through open intake valve 24 now drives piston 12 back towards cylinder head 17.

Because of the vast differences in cycles of the present invention over gasoline engines and the like, different procedures are necessary for both starting and stopping the engine. In the first embodiment, control of the water injector systems 32 may be used to both stop and start the engine. It is further necessary from a practical sense that a conventional starter be incorporated to force the piston to initiate gas flow. in the second embodiment illustrated in FIG. 3, the engine may be stopped by a valve 48*a* in pipeline 42*a* to cut off communication between the cylinders and the vacuum in tank 38*a*. Opening this valve will cause the engine to start again; however, a starter motor can be employed as well.

Thus, a variety of configurations are disclosed employing the vacuum generated by the solution of a gas in a solvent to derive power therefrom. While embodiments and applications of this invention have been shown and described, it would be apparent to those skilled in the art that many more modifications are possible without departing from the inventive concepts herein described. The invention, therefore, is not to be restricted except by the spirit of the appended claims.

What is claimed is:

1. An engine comprising:

at least one variable volume chamber;

a controlled intake passageway communicating with said chamber to be closed during contraction of said variable volume chamber;

a controlled exhaust passageway communicating with said chamber;

means for providing a gas to said intake passageway;

a solution tank containing a volume of solvent, said exhaust passageway extending into said volume of solvent; and power train means for deriving power from the vacuum which is created in said chamber.

2. The engine of claim 1 wherein a vacuum is initially formed in said solution tank.

3. An engine comprising:

at least one variable volume chamber;

a controlled intake passageway communicating with said chamber, said intake passageway being controlled to open during expansion of said variable volume chamber;

a controlled exhaust passageway communicating with said chamber, said exhaust passageway being controlled to be open when said chamber is near the minimum volume thereof;

means for dispersing water in said chamber, said dispersing means being controlled to operate when said chamber is near the maximum volume thereof, said controlled intake passageway and said controlled exhaust passageway being closed during the contraction of said variable volume chamber; and means for providing ammonia gas to said intake passageway.

4. An engine comprising:

at least one variable volume chamber;

a controlled intake passageway communicating with said chamber, said intake passageway being controlled to be open during expansion of said variable volume chamber and to be closed during contraction of said variable volume chamber;

a controlled exhaust passageway communicating with said chamber, said exhaust passageway being controlled to be open during contraction of said variable volume chamber;

a solution tank, said solution tank being sealed and in communication with said exhaust passageway for the passage of gas therebetween; said solution tank containing only water and the exhausted gases from said chamber said solution tank including means for physically dispersing exhausted gases below the level of said water; and means for providing ammonia gas to said intake passageway.

5. A method of generating mechanical power in a variable volume engine including the steps of:

filling a variable volume chamber with a gas;

dispersing a liquid solvent for the gas into the chamber when the volume thereof is near a maximum;

allowing the soluble gas to dissolve in the solvent liquid;

deriving power from the resulting decrease in pressure experienced within the chamber;

exhausting the solvent and dissolved gas from the volume; and repeating the above said steps.

6. A method of generating mechanical power in a variable volume engine, including the steps of:

supplying a variable volume chamber through a passageway with a gas;

closing the passageway to cut off the supply of gas to the variable volume chamber;

establishing an initial vacuum in a remote solution tank;

placing the variable volume chamber in communication with the remote solution tank;

dispersing the gas in a solvent for the gas in said remote solution tank;

deriving power from the resulting decrease in pressure experienced within the chamber; and repeating the above steps.

7. An engine comprising:

an intake passageway;

an exhaust passageway;

means located between said intake passageway and said exhaust passageway for deriving power from a gas pressure differential between said intake passageway and said exhaust passageway;

means for providing a gas to said intake passageway;

a solution tank, said solution tank being sealed and in communication with said exhaust passageway, said solution tank containing a solvent for the gas and an initial vacuum above said solvent said exhaust passageway extending into said solvent for dispersing gas passing through said exhaust passageway with said solvent for the gas.

8. The engine of claim 7 wherein said means for deriving power from a gas pressure differential includes at least one variable volume chamber having a controlled intake in communication with said intake passageway.

9. The engine of claim 8 wherein said variable volume chamber includes:

means for controlling communication with said intake passageway allowing communication during the expansion of said variable volume chamber and preventing communication during contraction of said variable volume chamber; and means for controlling communication with said exhaust passageway allowing communication during contraction of said variable volume chamber and preventing communication during expansion of said variable volume chamber.

10. The engine of claim 7 further including conversion means for removing the gas from the solvent for the gas and passageway means communicating said removed gas to said intake passageway, the separated solvent to the solution tank and mixed gas and solvent from the solution tank to said conversion means.

* * * * *